United States Patent [19]

Breton

[11] 4,038,583

[45] July 26, 1977

[54] APPARATUS FOR THE GENERATION OF NEGATIVE OR POSITIVE ATMOSPHERIC IONS

[76] Inventor: Jacques Leon Georges Breton, 9, avenue de Gradignan, Pessac, France

[21] Appl. No.: 625,901

[22] Filed: Oct. 28, 1975

[30] Foreign Application Priority Data

May 9, 1974 France ..... 74.16732

[51] Int. Cl.[2] ..... H05F 3/06

[52] U.S. Cl. ..... 361/230

[58] Field of Search ..... 317/4, 262 A; 250/324, 250/325, 326

[56] References Cited

U.S. PATENT DOCUMENTS

| | | | |
|---|---|---|---|
| 3,611,074 | 10/1971 | Weichardt | 317/262 A |
| 3,643,128 | 2/1972 | Testone | 317/4 |
| 3,843,906 | 10/1974 | Leibrecht | 317/262 A |

*Primary Examiner*—R. N. Envall, Jr.

*Attorney, Agent, or Firm*—Kinzer, Plyer, Dorn & McEachran

[57] ABSTRACT

Apparatus comprising at least one metallic point source generator of electrons or positive ions, and an apertured metal plate in front of said at least one source and arranged to act as an accelerating electric field screen, with said plate arranged to be raised to a voltage level between the voltage applied to said point source or sources and an earth voltage.

9 Claims, 5 Drawing Figures

Figure : 3
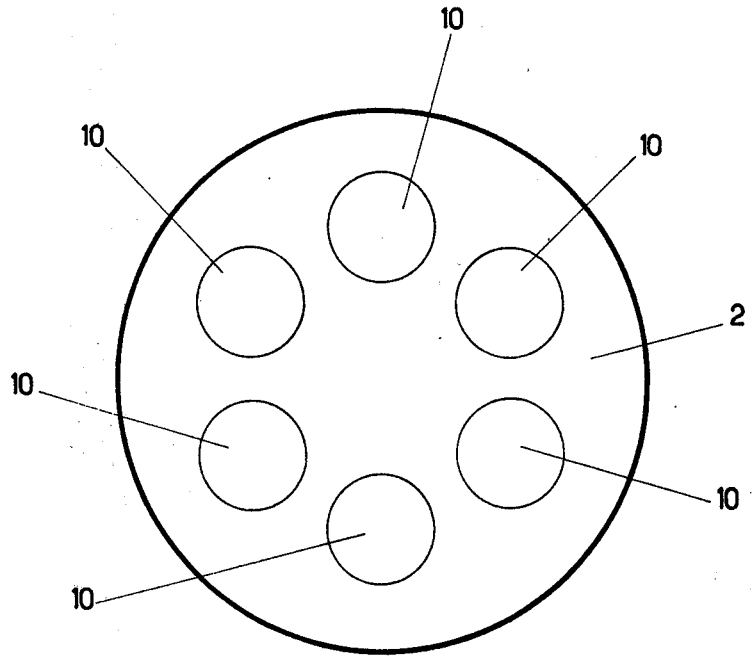
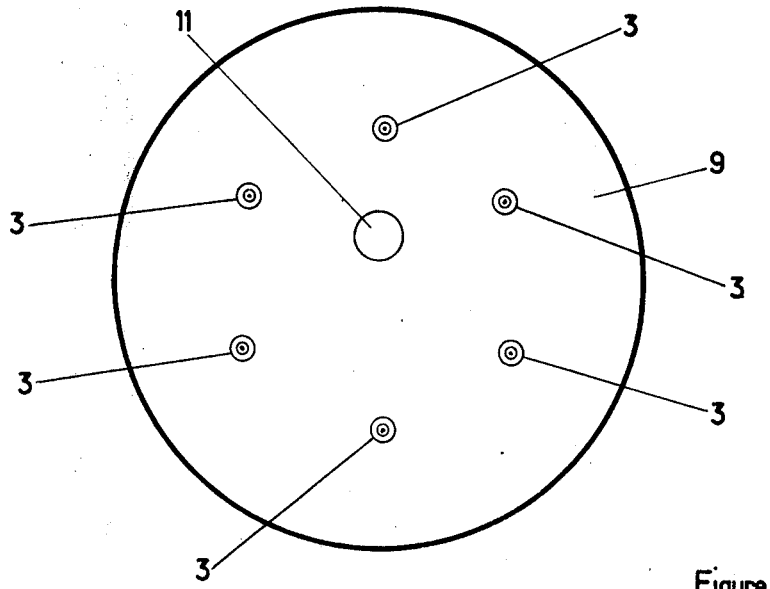
Figure : 4

APPARATUS FOR THE GENERATION OF NEGATIVE OR POSITIVE ATMOSPHERIC IONS

This invention relates to air ionisation apparatus arranged to produce, in the air, negative ions, or possibly positive ions, either in confined spaces or in free space, with a view to modifying the electrical character of the atmoshpere in respect of its physico-chemical or physiological properties.

The present invention enables the creation of an intense flux of atmospheric ions without the production of any measurable amount of ozone, the ion flux having a high penetration distance and an ouput (intensity of ion flux) which can be regulated in continuous manner between zero and the maximum available from the generator. One is enable by the present invention to arrange a variable number of ion generators in a given disposition, according to the result which one wishes to achieve.

In known ion generators of this type the atmospheric ions are generated at one or more sharp point sources raised to a voltage of several tens of thousands of volts with respect to the earth potentiel of the generator.

Such arrangements have however four essential drawbacks which severely limit their utilisation and/or their performance, viz:

the creation of ozone in addition to the ions (ozone being a gaseous substance which is extremely dangerous to living organisms, even in very small concentrations in the air) when the generator functions at a high voltage, for example greater than 20 kV, sufficient to ensure an adequate output of ions;

a very low output if one uses a less high voltage, for example less than 10 kV, sufficiently low to reduce the amount of ozone which is produced to a tolerable threshold level;

a distance of penetration of the ions in the atmosphere which is reduced to several decimeters due to the antagonistic or opposing spatial charge which develops in front of the point electrodes from which the ions travel;

the usual inability to regulate continuously the intensity of the ion flux produced, the value of which thus remains fixed.

These four real deficiencies of the known apparatus severely restrict the utilisation of the known air ionisers to a number of extremely low-key or limited applications.

It is an object of the present invention to provide an ionisation apparatus which overcomes the four aforesaid deficiencies. The apparatus of the present invention enables the generation of an ion flux which is as large and as concentrated as one needs, without the production of a discernible amount of ozone, and with the penetration distance of the ions being capable of being regulated to a selected value in continuous manner by a single signal from the generator. One can also create a more intense ion flux simply by the combination of several "heads" connected to a single high voltage source which may be remote from the particular site of application. Such an arrangement will be dependent upon the particular conditions of the site of use, for example whether it is a room, a shop, etc.

In accordance with the invention there is provided apparatus for the generation of negative or positive atmospheric ions within a confined or free space, the apparatus comprising at least one metallic point source generator of electrons or positive ions, and an apertured metal plate in front of said at least one source and arranged to act as an accelerating electric field screen, with said plate arranged to be raised to a voltage level between the voltage applied to said point source or sources and an earth voltage.

The apparatus of the present invention may be made up from two sub-assemblies; an ionisation "head", and its high tension supply. The ionisation head comprises, according to one embodiment of the invention, an assembly of three pieces of electrically insulating material connected by two cylindrical screw-threaded pieces each carrying a metal plate. One of these plates carries the sharp point source or sources of non-oxidising metal and is connectedto one high tension lead; the second plate, positioned in front of the first plate, performs the role of an accelerating screen and is preferably provided with circular holes arranged in alignment with the point source or sources of the first plate.

The application to the apparatus of a continuously adjustable voltage is effected, according to one embodiment of the invention, by the use of two high tension leads which are electrically insulated from one another and which are connected to a source of rectified voltage obtained from a diode and capacitor network to which an alternating voltage is fed from an assembly of two transformers, one of constant output and the other of variable output between zero and a predetermined maximum. The input variable transformer is connected to an a.c. mains supply, or, if independent of the mains supply, to an alternating voltage generator powered by a battery or accumulator.

According to another preferred feature of the invention, the point source ion generators and the accelerating plate may be connected respectively to two high voltage sources such as described above, where the voltages of the two sources are manually adjustable independently and not simultaneously.

In order that the invention may be more fully understood, one preferred embodiment in accordance therewith will now be described in detail by way of example and with reference to the accompanying drawings, in which:

FIG. 3 is a plan view of the apertured plate of the apparatus of FIG. 1;

FIG. 4 is a plan view of the plate carrying the point sources; and

Figure 1:
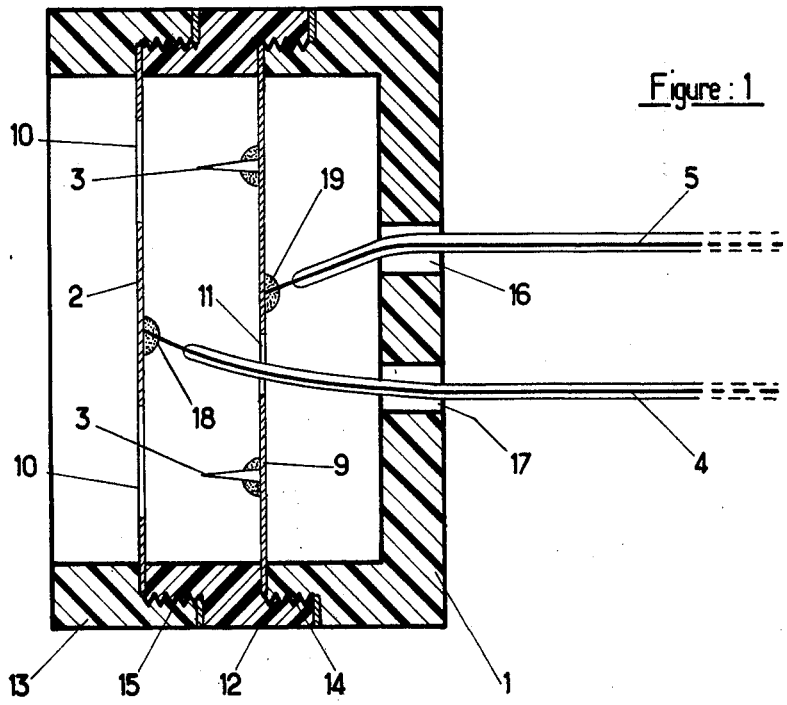
FIG. 1 is a sectional view through the ionisation head.
Figure 2:
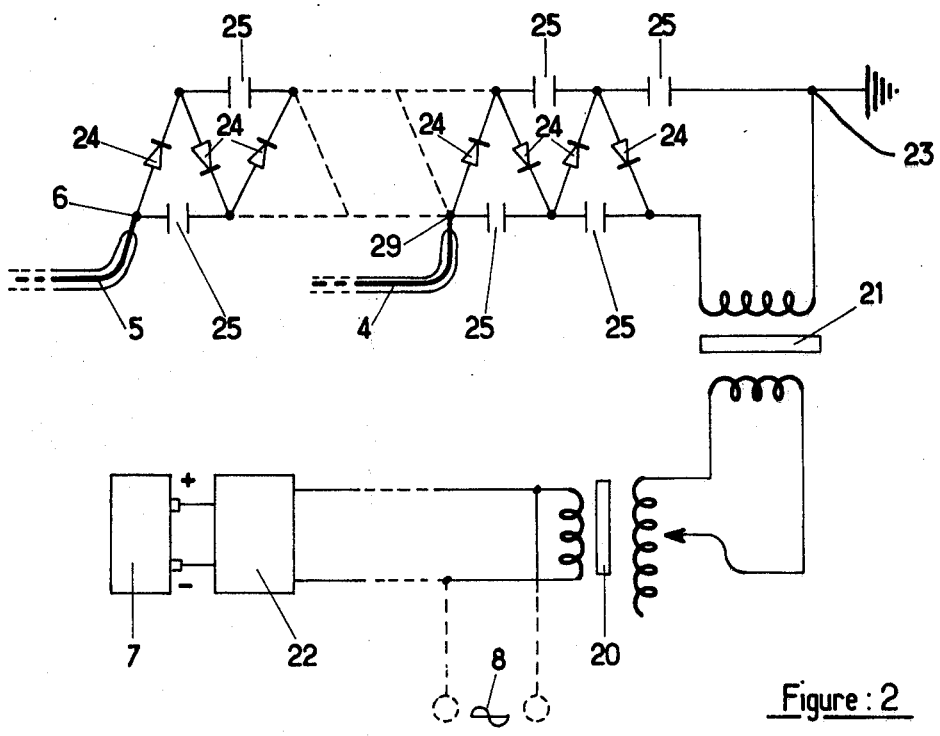
FIG. 2 is a circuit diagram illustrating the generation of the voltage supplies for the apparatus of FIG. 1.

Referring to the drawings, and first in particular to FIGS. 1 and 2, the apparatus comprises an insulating cup-shaped housing in three parts 1, 12 and 13, connected together by screw-threads 14 and 15 and supporting a first metal plate 9 carrying points 3 of unoxidisable metal, and a second metal plate 2 constituting an accelerating grid or screen and having circular holes 10 therethrough in alignment with the point sources 3 for the passage of ions. A first connecting lead 4 extends through a hole 17 in the base of the housing 1 and through a hole 11 in the plate 9 for connection to the plate 2 at 18. A second connecting lead 5 extends through a similar hole 16 in the base of the housing 1 and is connected at 19 to the plate 9 carrying the points 3. The connecting leads 4 and 5 are connected at their other ends respectively to terminals 29 and 6 of a high voltage source. The plate 2 is thus connected through the terminal 29 to an intermediate voltage between earth 23 and the voltage at terminal 6 which is applied to the points 3.

The continuous high voltages at terminals 6 and 29 are obtained by a voltage multiplier arrangement comprising a rectifying assembly of diodes 24 and capacitors 25 connected to an alternating voltage source provided by a step-up transformer 21. The transformers 21 is connected to a transformer 20 which provides a variable output voltage and which is connected at its input side directly to the a.c. mains supply 8, or alternatively, for use independently of the mains supply, to an alternating voltage generator 22 powered by batteries 7 for example.

Figure 5:
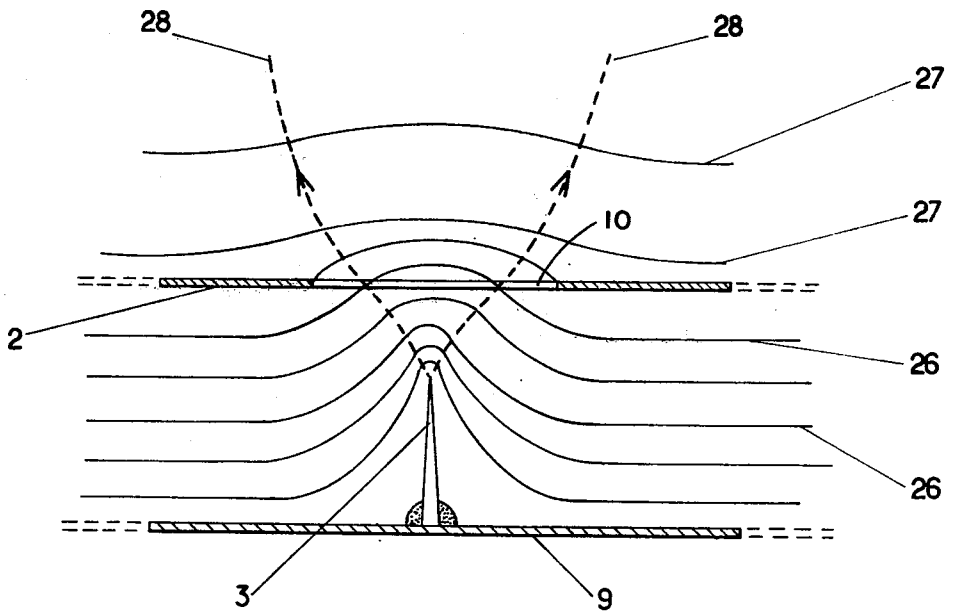
FIG. 5 is a schematic diagram to indicate the electrical field between and adjacent to the metal plates and in the neighbourhood of the point sources.

When the plate 9 carrying the points 3 and the apertured plate 2 are connected to the high voltage terminals 6 and 29 the topography of the electric field between and around the plates is as illustrated in FIG. 5. In the space between the two plates 9 and 2 the equipotential lines 26 have a very "dense" configuration and there correspond to an electric field which, with the arrangement described above, is of the order of 250,000 V/m. Conversely, in the exterior space, in front of the apertured plate 2, the equi-potential lines 27 show that there is only a weak electric field of the order of 1,000 V/m. The lines of force 28 of the electric field defining the course of the electrons or of the negative oxygen ions, which because of the topography of the field are not likely to be captured by the screen 2, assure their projection out through the holes in the plate 2 within a solid angle of the order of 30°. By retaining the major part of their kinetic energy after issuing from the ionisation head, i.e. conversion of high potential energy to kinetic energy, these escaping ions therefore have the ability to penetrate great distances into the ambient atmosphere in front of the ion generator.

The second plate 2, which is connected to an intermediate level voltage between zero and the voltage of the first plate 9, has a four-fold function: (a) it ensures a very strong initial acceleration of the ions produced at the point sources within the space which separates the two metal plates, owing to the high level of the potential gradient (electric field) which it maintains in this space; (b) it ensures that when the ions issue from the holes therein they are subject to a supplementary post-acceleration in addition to the pre-acceleration, and in this way prevents the formation of a local spatial charge which would hinder the diffusion of the issuing ions; (c) it also performs the role of an electronic lens in ensuring that the ions are emitted with the optimum trajectory; and (d) it avoids the production of ozone in that it uses only a moderate accelerating voltage (less than 10,000 volts), even though producing a very high output from the ionisation head (greater than $10^{13}$ electrons per second according to one embodiment of the invention).

According to another embodiment of the invention, the ionisation head comprises only one point generator in association with a screen plate which is provided with just one single aperture, this arrangement being designed for very localized use both in respect of the direction of emission of ions and in respect of ion range.

According to yet another embodiment of the invention, the ionisation head comprises an array of point generators of ions in the form of an elongated array arranged behind a screen plate of the same dimensions and set up according to the precise requirements described above. According to another embodiment, a number of ionisation heads may be connected to the same high tension source, and distributed at different points of one location or in a number of different neighbouring locations. Such a set-up can be arranged to ensure an extremely high output, for example greater than $10^{14}$ electrons per second, or near to 0.01 miliamps, within a closed spaced of large dimensions or in open space.

The apparatus of the present invention can be utilised in all circumstances where the presence of negative atmospheric ions, or positive ions, is judged to be necessary, either to effect a modification of the physicochemical character of the atmosphere in either a free or a confined space, or to modify the physiological character of the atmosphere (the definition of a local micro-climate), or to effect direct action upon a pathological site characterised by an anomaly or a departure from the normal condition. The apparatus is of particular use in industrial locations, in public places and in land vehicles and in aircraft, to restore the necessary concentration of negative ions by neutralisation and precipitation of positively charged ions or particles. The apparatus can equally well restore the ionic equilibrium of the atmosphere in confined spaces which are under the influence of a generator of undesirable positive ions.

The apparatus can also be used in medical environments and hospitals in order to ensure that patients receive the rate of negative ions indispensable to their physiological recovery. The apparatus can be utilised in doctors' surgeries in view of its individual application to illnesses susceptible to intensive treatment.

The apparatus can be used in general in all places and under all circumstances requiring the creation of atmospheric ions at high output levels, without any constraint on the distribution of the sources, wherein the output and final concentration of ions can be strictly controlled or programmed, if necessary by remote control.

I claim:

1. Apparatus for generating negative or positive atmospheric ions, within a confined or free atmospheric space, with a high and adjustable yield and a large distance penetration and no appreciable ozone production, comprising:

an ionizing electrode comprising at least one ionizing point;

an acceleration electrode comprising a conductive plate spaced outwardly from the tip of the ionizing electrode point and having an acceleration and focussing aperture with a diameter substantially larger than the maximum diameter of the ionizing point and aligned with the axis of the ionizing point;

and high voltage supply means, connected to the two electrodes, for maintaining the ionizing electrode at a high voltage of given polarity and for maintaining the acceleration electrode at a substantially lower voltage of the same polarity, so that the configurations of the equipotential surfaces between the two electrodes and externally of the acceleration electrode are only a function of the ratio of the voltage of the two electrodes and afford an electronic lens having an axis coincident with the axis of the ionizing point.

2. Ion generating apparatus according to claim 1, in which the configuration of the equipotential surfaces affords a high pre-acceleration of ions emitted by the ionizing point electrode in the space between the two electrodes and an appreciable post-acceleration in the atmospheric space beyond the acceleration electrode, without substantial capture of ions by the acceleration electrode, and without creating an opposing space charge in the vicinity of the tip of the ionizing point.

3. Ion generating apparatus according to claim 2 in which the ionizing electrode includes a plurality of ionizing points and the acceleration electrode includes a corresponding plurality of acceleration and focusing apertures aligned therewith one-for-one, and in which the high voltage supply comprises a voltage divider having an intermediate outlet terminal connected to the acceleration electrode and a total voltage output terminal connected to the ionizing electrode, so that varying potentials which remain in a constant ratio can be applied to the two electrodes without change of configuration of the equipotentials.

4. Ion generating apparatus according to claim 3, in which the high voltage supply comprises a variable ratio transformer, connected to a rectifier circuit, and produces a continuous flow of ions variable between zero and a predetermined maximum.

5. Ion generating and distributing apparatus, according to claim 3, in which the electric field density between two electrodes is of the order of 250,000 volts per meter and the electric field density immediately externally of the acceleration electrode is of the order of 1,000 volts per meter.

6. Apparatus for generating and distributing ions in a free atmospheric space, with no appreciable ozone production, including a plurality of ion generators disposed within that space, each ion generator comprising:

an ionizing electrode including a plurality of electrically interconnected ionizing points each projecting toward said space;

an acceleration electrode comprising a conductive plate spaced outwardly from the tips of the ionizing electrode points and having a plurality of acceleration and focussing apertures therein, each aperture aligned with an ionizing point and having a diameter much larger than the diameter of the ionizing point;

said apertures further including high voltage supply means, electrically connected to the ionizing and acceleration electrodes of the ion generators, for maintaining the ionizing electrode of each ion generator at a high voltage of given polarity and for maintaining the acceleration electrode thereof at a substantially lower voltage of the same polarity, so that the configurations of the equipotential surfaces between the two electrodes and externally of the acceleration electrode in each ion generator afford a plurality of electron lenses, one for each ionizing point, coincident with the axes of the ionizing points, the high voltage supply means including means to adjust the absolute voltages on the electrodes while maintaining a constant voltage ratio between the ionizing and acceleration electrodes.

7. Ion generating and distributing apparatus, according to claim 6, in which the electric field density between the two electrodes of each ion generator is of the order of 250,000 volts per meter and the electric field density immediately externally of the acceleration electrode is of the order of 1,000 volts per meter.

8. Ion generating and distributing apparatus, according to claim 6, including at least one positive ion generator and at least one negative ion generator.

9. Ion generating and distributing apparatus, according to claim 6, in which a single high voltage supply circuit, including a variable transformer, is connected to all of the ion generators.

* * * * *